US006971616B1

(12) United States Patent
Lake

(10) Patent No.: US 6,971,616 B1
(45) Date of Patent: Dec. 6, 2005

(54) CLIPBOARD

(76) Inventor: Gary F. Lake, 235 Avenida Del Monte, Bishop, CA (US) 93514

( * ) Notice: Subject to any disclaimer, the term of this patent is extended or adjusted under 35 U.S.C. 154(b) by 259 days.

(21) Appl. No.: 10/667,767

(22) Filed: Sep. 22, 2003

(51) Int. Cl.[7] ..... A47B 97/04
(52) U.S. Cl. ..... 248/252; 24/67.3
(58) Field of Search ..... 434/408, 422, 434/423; 24/67.3, 67.5, 67.7; 248/451, 452, 248/453; 281/45, 50; D19/88

(56) References Cited

U.S. PATENT DOCUMENTS

| | | | | |
|---|---|---|---|---|
| 297,284 A | | 4/1884 | Mudgett | |
| 1,563,508 A | | 12/1925 | Maynard | |
| 1,615,275 A | | 1/1927 | Horn | |
| 3,085,777 A | | 4/1963 | Lewtan et al | 248/206 |
| 3,105,279 A | | 10/1963 | Westhoff | 24/81 |
| 3,127,649 A | | 4/1964 | Linsenmayer | 24/66 |
| 3,710,423 A | * | 1/1973 | Zimpleman | 24/67.5 |
| 4,157,152 A | | 6/1979 | Blastic | 224/247 |
| D298,955 S | * | 12/1988 | Zovar | D19/88 |
| D318,881 S | * | 8/1991 | Chase | D19/88 |
| 5,226,215 A | * | 7/1993 | Evenson | 24/67.5 |
| 5,725,250 A | | 3/1998 | Balderrama | 281/45 |
| 5,823,574 A | * | 10/1998 | Sullins et al. | 281/45 |
| D428,927 S | * | 8/2000 | Chang | D19/88 |
| 6,216,996 B1 | | 4/2001 | Shamoon | 248/452 |
| D446,549 S | | 8/2001 | Cheris et al. | D19/88 |
| 6,386,589 B1 | | 5/2002 | Yuh | 281/45 |
| 6,470,536 B1 | | 10/2002 | Kettlestrings et al. | 24/67.7 |
| D469,812 S | | 2/2003 | Isaacs | D19/88 |
| D487,579 S | * | 3/2004 | Chen | D19/88 |

FOREIGN PATENT DOCUMENTS

WO WO/21508 9/1994

* cited by examiner

*Primary Examiner*—Kurt Fernstrom
(74) *Attorney, Agent, or Firm*—James G O'Neill; Klein O'Neill & Singh, LLP

(57) ABSTRACT

A clipboard having an improved paper clamping element is disclosed. The clipboard has a planar board member with a front face, a rear face, two side edges, a top end, a bottom end and a clamping mechanism having at least one biasing element and a clamping element. The clamping element has at least one paper clamp cooperating with a holding element. The planar board member has at least one slot for penetration of the paper clamp through the planar board member from the rear face of the planar board to the front face. A writing implement holder and a carrying handle may be incorporated into the clamping mechanism.

20 Claims, 4 Drawing Sheets

CLIPBOARD

FIELD OF THE INVENTION

The present invention relates to clipboards and more particularly to clipboards with improved paper retention means. The clipboards of the present invention may also be provided with a handle and a holder element for holding a writing implement.

DESCRIPTION OF RELATED ART

A clipboard is commonly defined as a portable board with a clip attached at the top end of the board, used for securing papers and providing a hard writing surface for use by persons in various situations, such as while on the move, standing or when no flat writing surface is available.

The most common clipboards comprise a flat wooden or plastic board having a spring biased clip for holding papers mounted on one end. Writing implement holders have also been provided on the clipboards of the prior art. U.S. Pat. No. 3,085,777 defines a magnetic clipboard with means for holding a pencil. U.S. Pat. No. 3,105,279 has a pencil holder, which extends through a slot and overlies the biasing spring on one side of the slot while providing a portion overlying the clamp plate on the other side of the slot for clamping a pencil. U.S Pat. No. 5,725,250 uses an apertured edge in the clamping member to capture a writing instrument disposed longitudinally relative to the board to assist in retention of papers on the board. U.S Pat. No. 6,386,589 defines a clipboard comprising a clip mechanism having an offset flange formed with a shelf like tray at the end to provide an enlarged paper-engaging surface to safeguard the papers on the board.

The conventional clipboards have a spring-biased clip clamped or otherwise held to the board with the help of screws and/or rivets. The presence of rivets and screws affects the time required during assembly and the life of the clipboard. Further, the available spring biased clips tend to be bulky and do not always work efficiently. Furthermore, they tend to cover large portions of the papers held on the clipboard.

Therefore, there exists a need in the art for an improved clipboard having improved means to hold and secure paper, while covering less of the paper, which may include an integrated writing implement holder and carrying handle. Further, considering the aesthetic value of any device being as important as the functional value, it is desirable to have a clipboard that provides a solution to the bulky clipboards known in the prior art.

SUMMARY OF THE INVENTION

Accordingly, it is an object of the present invention to provide a novel clipboard. More particularly, it is an object of the present invention to provide clipboards having improved paper retention means, covering less of the paper. It is a further particular object of the present invention to provide clipboards having improved paper retention means, covering less of the paper, together with an integrated writing implement holder. It is a still further particular object of the present invention to provide clipboards having improved paper retention means, covering less of the paper, together with an integrated writing implement holder and a carrying handle.

In one embodiment of the present invention there is provided a clipboard comprising a planar board member having a front face, a rear face, two side edges, top and bottom ends and a clamping mechanism. The clamping mechanism has at least one clamping element or portion, a biasing element and a holding or pivoting element or portion. The planar board member has at least one slot passing from a rear surface to a front surface for penetration of the at least one clamping element or portion through the board member from the rear face to the front face.

In a second embodiment of the present invention there is provided a clipboard having a planar board member, clamping mechanism having a paper retention means and a writing implement holder. The clamping mechanism has a biasing element and a combination clamping and holding element or portion including at least one paper clamp with an integrated holding element. The planar board member has at least one slot for penetration of the paper clamp through the planar board member from the rear face to the front face.

In a third embodiment of the present invention there is disclosed a clipboard having a clamping mechanism with improved paper retention means and a writing implement holder. The clamping mechanism has a biasing element and a clamping element with a separate holding element and at least one paper clamp. The planar board member has at least one slot for penetration of the at least one paper clamp through the planar board member from the rear face to the front face.

The clipboards of the present invention may have planar board members with a plurality of notches at the side edges for aid in securing papers to the front face of the planar board members with an elastic band.

The clipboards of the present invention preferably are provided with carrying handles formed by the planar board member and/or the clamping mechanism.

Additionally, the clipboards of the present invention may be provided with at least one centrally placed notch in or adjacent an opening in the top end for hanging or mounting the clipboard on a wall or similar surface.

Further objects and advantages of this invention will become apparent through the following description with reference to the accompanying drawings.

BRIEF DESCRIPTION OF THE DRAWINGS

The present invention, both as to its organization and manner of operation, together with further objects and advantages, may best be understood by reference to the accompanying drawings, in which.

DESCRIPTION OF THE PREFFERED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein to provide for an improved clipboard.

As shown in FIGS. 1–7 a first embodiment of the clipboard is illustrated at 10 for use in holding and securing paper and a writing implement.

Figure 1:
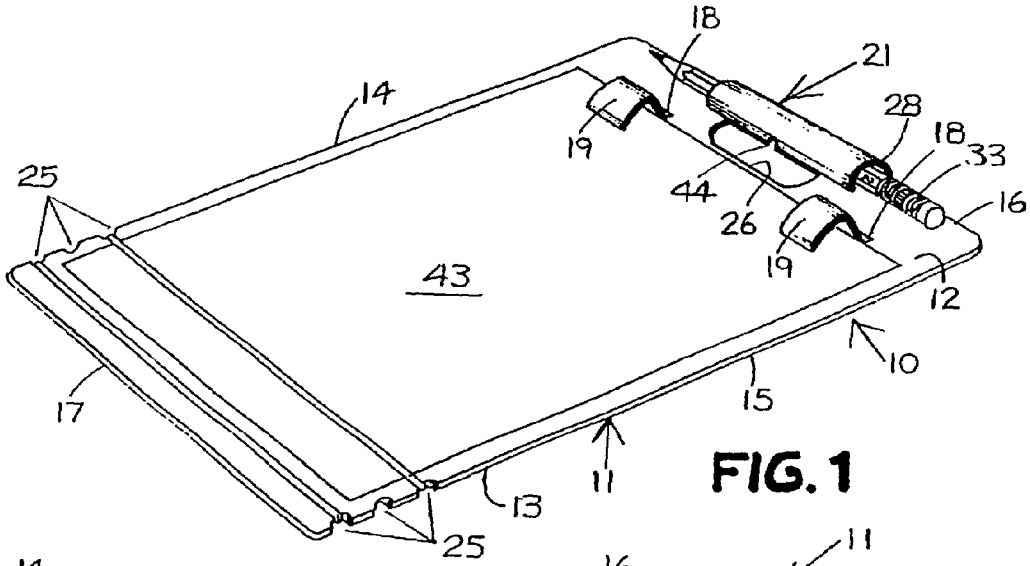
FIG. 1 is a top perspective view of a first embodiment of a clipboard according to the present invention.
Figure 2:
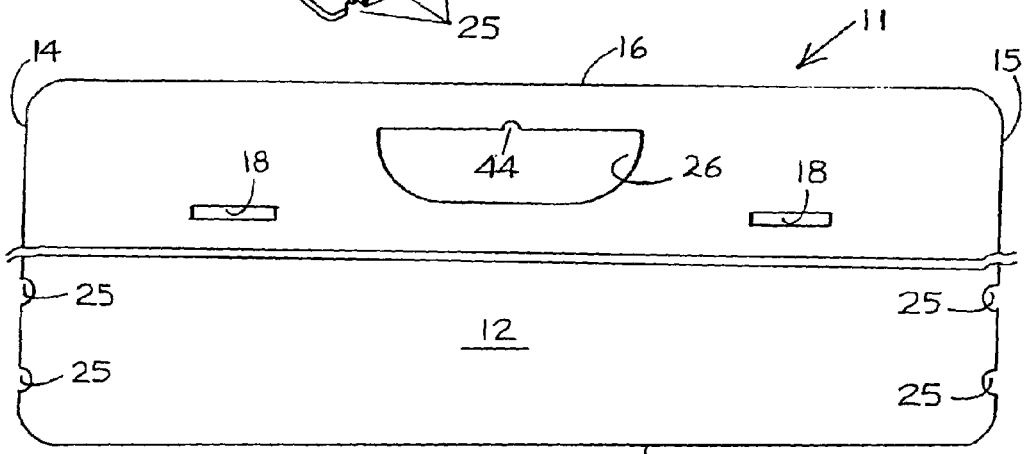
FIG. 2 is a top elevational view of the planar board member of FIG. 1.

Turning first to FIG. 1, there shown is a clipboard 10 comprising a planar board member 11 having a front face 12, a rear face 13, two side edges 14, 15, a top end 16 and a bottom end 17. At least one slot 18 is formed passing through planar board member 11 adjacent the top end 16 to allow or facilitate the penetration of the planar board member by one or more paper clamps 19 on a clamping element 20 of a clamping mechanism 21 (also referred to as a two-piece interlocking mechanism) from the rear face 13 to the front face 12 (see FIG. 7).

The clamping mechanism 21 comprises at least one paper clamp 19 on the clamping element 20, a biasing element 22 and an interlocking holding or pivoting element 23. The holding or pivoting element 23 is interlocked with the clamping element 20 by means of confinement slot, grove or ridge 24. This interlocking embodiment requires no rivets, nuts or bolts, or adhesives to secure the clamping mechanism 21 to the planar board member 11.

The planar board member 11 has a plurality of notches 25 formed on the side edges 14, 15 near the bottom end 17 for holding bands or the like. The board member 11 also preferably includes two slots 18 for insertion and holding of two paper clamps 19 of the clamping element 20. The planar board member 11 may also include an aperture or opening 26 passing through the board adjacent the top end 16.

The notches 25 in the planar board member 11 function to hold a number of holding bands, such as elastic or rubber bands, that can be transferred from the lowest set of notches (below papers 43 being held on the board) to one or more upper set of notches. These elastic bands serve to hold the papers 43 more securely at the bottom portion of the planar board 11, when desired, especially when the clipboard 10 is being carried or in windy outdoor conditions. The conventional rubber bands could be replaced with a single, Bungee like band that is adhered to the rear face 13 of the board 11 between the sets of notches.

Figure 4:
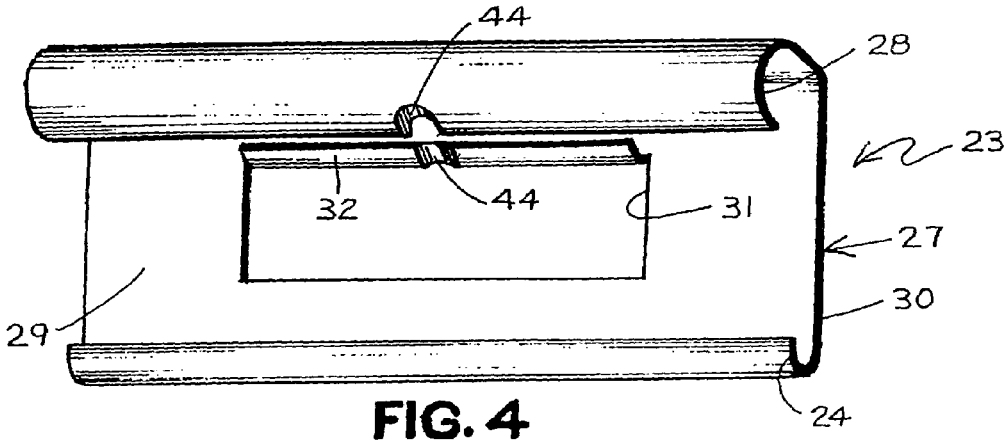
FIG. 4 is a top perspective view of the writing implement holding element or portion shown in FIG. 3.
Figure 6:
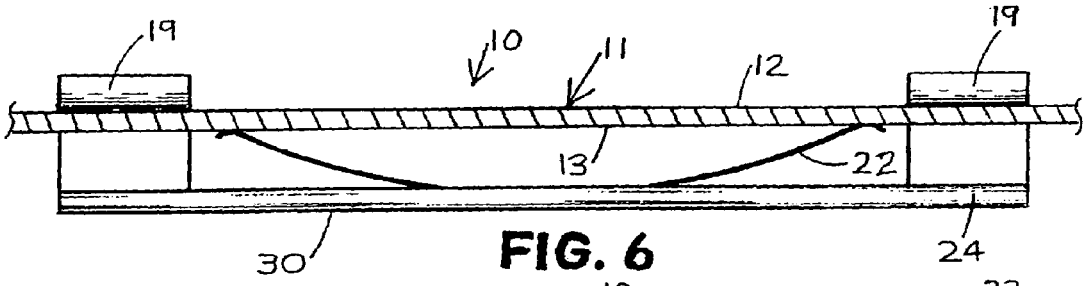
FIG. 6 is a partial cross-sectional view through the top end of the clipboard of FIG. 1 showing paper clamps passing through slots in the planar board member and the general location of a leaf spring biasing element.
Figure 7:
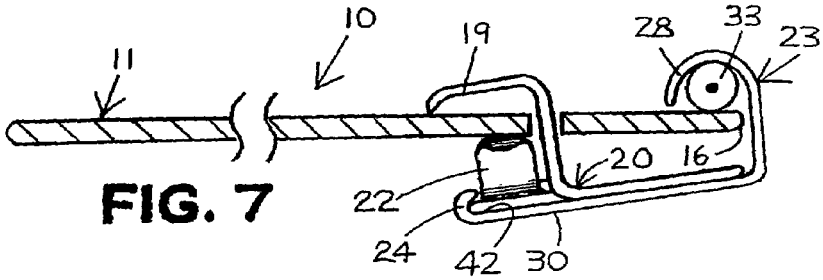
FIG. 7 is a partial cross-sectional view through the clipboard of FIG. 1 showing the paper clamping element against the top face of the planar board member interlocked with the paper clamping element and the writing implement holding element with a writing implement held against the top face, and the leaf spring biasing element in a holding channel.

As best shown in FIG. 4, the holding element 23 is formed from a substantially rectangular plate 27 having a top end with an extending semi-circular channel 28, a bottom end having the interlocking groove or ridge 24, a front face 29 and a rear face 30 (see FIGS. 6 and 7). An aperture 31 is formed substantially centrally in the rectangular plate 27 and includes an upstanding confinement tab 32 at a top end thereof, adjacent the channel 28. The semi-circular channel 28 extends along the top of the rectangular plate 27 and will ride over the top end 16 of the planar board member 11 when mounted thereon (see FIGS. 1 and 7). This semi-circular channel 28 is configured to hold various size writing implements 33.

Figure 3:
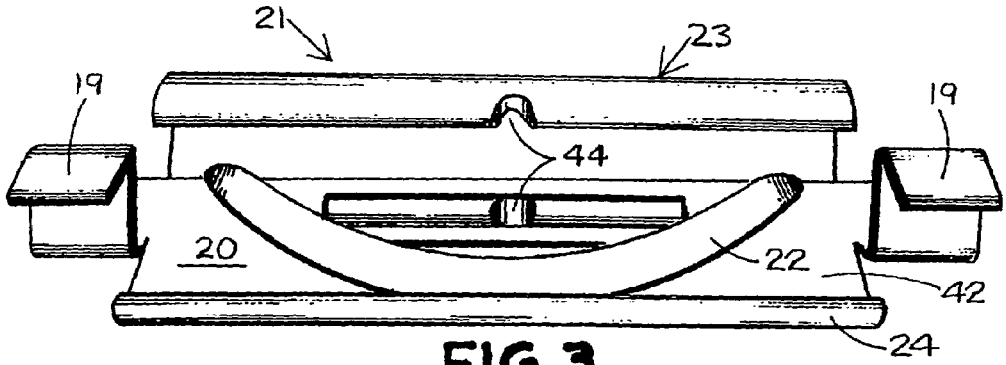
FIG. 3 is a top perspective view of the clamping mechanism of FIG. 1, removed from the planar board member and showing a leaf spring biasing element held in a holding channel in a paper clamping element or portion interlocked with a writing implement holding element or portion.
Figure 5:
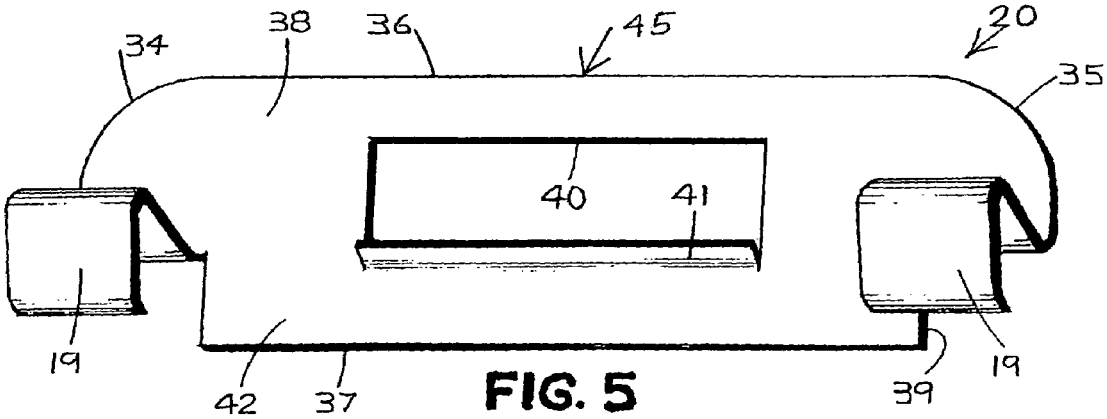
FIG. 5 is a top perspective view of the paper clamping element or portion shown in FIG. 3.

Turning now to FIG. 5 the clamping element 20 is shown formed from a rectangular plate 45 having rounded top edges 34, 35 connected by a top end 36. The plate 45 includes a bottom end 37, a front face 38 and a rear face 39. The rectangular plate 45 further includes a centrally formed aperture 40 with an upstanding alignment tab 41 at its bottom end extending along the width of the aperture. The alignment tab 41 facilitates the alignment of the clamping element 20 with the holding element 23, when they are assembled together, as shown in FIGS. 3 and 7.

The biasing element 22 rests on a spring channel 42 formed beneath the aperture 40 on the clamping element 20 and extends between the pair of paper clamps 19 that are preferably formed on and extend upwardly from the plate 45. If a single paper clamp 19 is formed it would extend along any desired length on the rectangular plate 45.

As shown in FIG. 7, when the clamping element 20 and the holding element 23 are interlocked together and held on the planar board 11, after the holding element 23 has been slid over the clamping element 20 during assembly of the clipboard 10, the biasing element 22 is held in or rests on the spring channel 42 of the clamping element, adjacent the ridge 24 of the holding element. This two-piece configuration of the clamping mechanism 21 provides better paper retention and writing implement holding on the clipboard 10.

The spring channel 42 nestles in or against the interlocking groove or ridge 24 of the holding element 23. The confinement tab 32 of the holding element 23 acts as a resting point for the top end of the aperture 40 of the clamping element 20 and the alignment tab 32 rests against the bottom end of the aperture of the clamping element 23 to hold the two-piece clamping mechanism together.

When the biasing element 22 is in the spring channel 42 it is skewed slightly towards the paper clamps 19, to enhance the paper clamping function by providing more of the pressure from the biasing element than is applied to the semi-circular channel 28 holding a writing implement 33. The position of the biasing element 22 is best shown in FIG. 7.

The materials used in the manufacture of the clamping mechanism and planar board member may be wood, steel, aluminum or plastic, or any suitable combination thereof. Manufacturing techniques are chosen from die-cut, extrusion and injection molding. It is within the scope of the present invention to manufacture all components of the clipboard from plastics, including the biasing element.

The dimensions and the number of slots 18 in the planar board member 11 conform to the dimensions and the number of the paper clamps 19 of the clamping element 20 and are sized and dimensioned to provide the most beneficial and efficient use of the clipboard. For example, as shown, when the clamping element 20 has a pair of paper clamps 19, the planar board member 11 also has a pair of slots 18 conforming in size to the clamps 19. The paper clamps 19 of the clamping element 20 hook through the slots 18 of the planar board member 11. In a currently preferred embodiment of the invention the paper clamps 19 are approximately ¾ of an inch wide and of a length selected so as to hold or clamp a predetermined thickness of papers.

The centrally placed aperture 26 of the planar board member 11 is preferably aligned with the apertures 31 and 40 to form a handle to enable the clipboard 10 to be carried. Additionally, the aperture 26, and/or the semi-circular channel 28 and the upstanding confinement tab 32 may have notches 44 formed therein near the top end 16 to enable the clipboard 10 to be hung on a wall, or the like.

FIGS. 8–11 illustrate a second embodiment of a clipboard 50 of the present invention having an integral or one-piece clamping mechanism 51 with at least one paper clamp 52 for securing paper to the clipboard and a holding element 53 for holding a writing implement.

As shown, the clipboard 50 comprises the planar board member 11 and the clamping mechanism 51 having the at least one paper clamp portion or element 52 formed integrally with or as one-piece with the writing implement holding element or portion 53. The clamping mechanism 51 also has a spring channel 54 formed integrally with the paper clamp 52 and writing implement holding portion 53. The spring channel 54 may selectively hold a leaf spring biasing element 22 or one or more coil springs 55.

Figure 8:
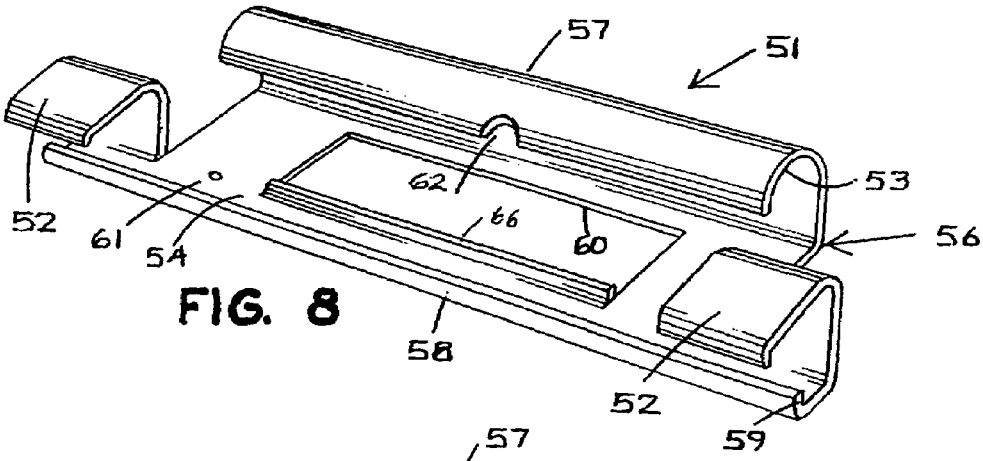
FIG. 8 is top perspective view of a second embodiment of a clamping mechanism of the present invention.

FIG. 8 shows a top perspective view of the one-piece clamping mechanism 51 having a pair of paper clamps 52. The clamping mechanism 51 is formed from a substantially rectangular plate 56 having a top end 57 and a bottom end 58. The paper clamps 52 are formed at opposed sides of the rectangular plate 56, adjacent the spring channel 54 and bottom end 58. The bottom end 58 of the clamping mechanism 51 has an inwardly or upwardly bent indent or lip 59 opposite a lip 66 at the bottom end of the aperture 60, forming part of the spring channel 54.

The writing implement holding element or portion 53 is formed as a semi-circular channel extending along the top end 57. This cylindrical channel is configured to act as a holding element for holding the writing implement 33. When the clamping mechanism 51 is mounted to the planar board member 11, the cylindrical channel 53 extends over and along the top end 16 onto the front face 12 thereby providing the holder for the writing implement 33.

The clamping mechanism 51 may also include a centrally placed aperture 60. This aperture 60 conforms in shape and configuration to the aperture 26 provided adjacent the top end 16 of the planar board 11.

Figure 9:
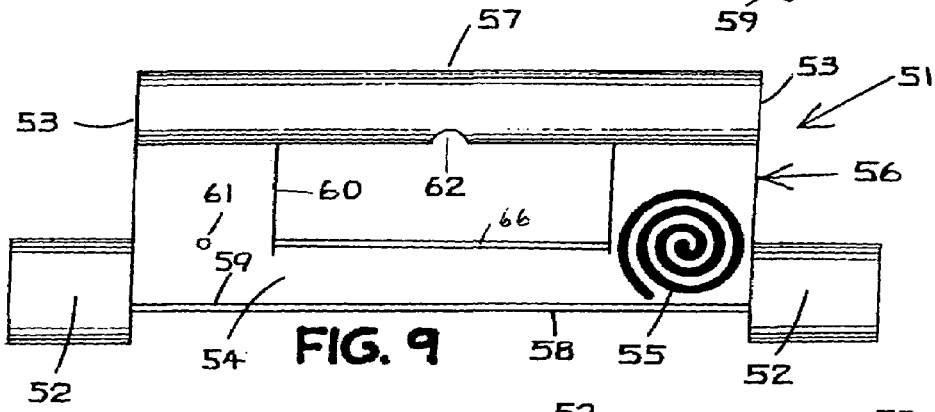
FIG. 9 is a top elevational view of the clamping mechanism of FIG. 8.

FIG. 9 shows a top elevational view of the single-piece or integrated clamping mechanism 51 utilizing a coil spring biasing element 55. Alignment holes or openings 61 may be provided in which one or more coil springs 55 may be positively seated.

The cylindrical channel 53 may also include a centrally placed notch 62, which may be aligned with notch 44 in aperture 26, enabling hanging of the clipboard on a wall or similar surface.

Figure 10:
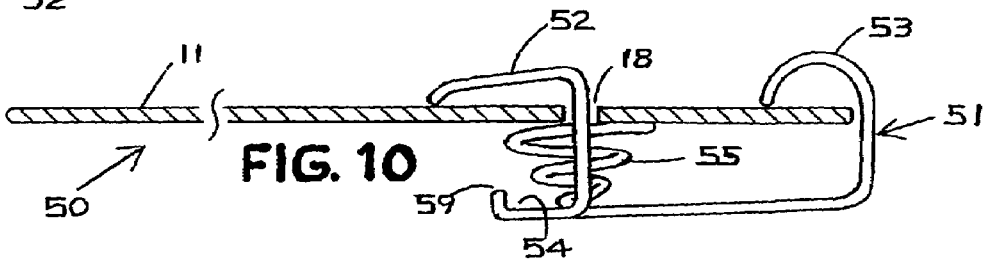
FIG. 10 is a partial cross-sectional view of a clipboard with the clamping mechanism of FIG. 8 held in a planar board member.

FIG. 10 shows the clipboard 50 with the clamping mechanism 51 secured thereon. The coil spring or springs 55 used as biasing elements may be of the type that require minimal space as they collapse within themselves, flattening to the diameter of the spring wire used. The tip of the wire at the small end of the spring may be bent, away and parallel to the axis of the spring to seat in the spring positioning holes 61.

Figure 11:
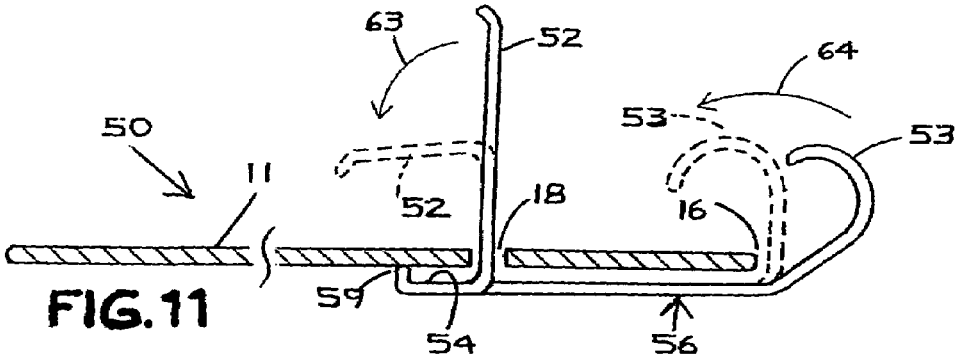
FIG. 11 is a further partial cross-sectional view similar to FIG. 10, showing methods of assembling the clamping mechanism of FIG. 8 to the planar board member.
Figure 12:
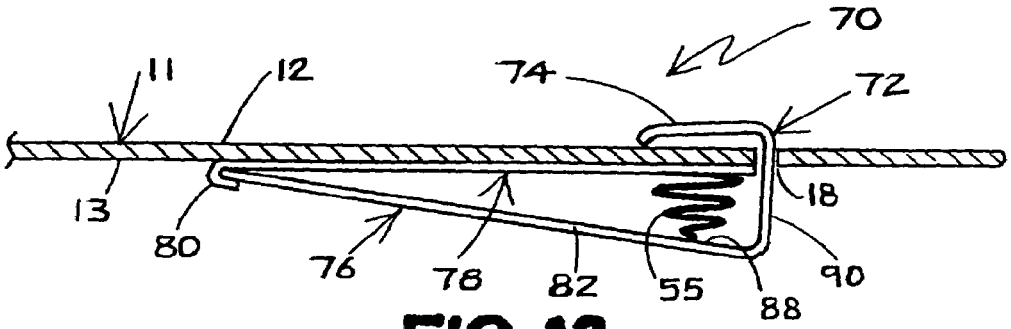
FIG. 12 is a partial cross-sectional view of a third embodiment of a clipboard of the present invention, with a clamping mechanism held on a planar board member.

Various methods of assembling the clipboard 50 are shown in FIG. 11. The clamping mechanism is partially formed, with either the two paper clamps 52 in the bent form, or substantially perpendicular to the plate 56, and the cylindrical channel 53 partially bent toward its final or operating poison, as shown in solid line in FIG. 11. The two paper clamps 52, bent or unbent, are then inserted through the slots 18 in the planar board 11 with the cylindrical channel 53 adjacent the top end 16. If the paper clamps 52 are perpendicular to the planar board 11 they are bent in the direction of arrow 63 to a position substantially parallel to the top face 12 of the planar board, as shown in broken line. The cylindrical channel 53 is bent in the direction of arrow 64 to a position above the top face 12, as shown in broken line. The biasing element(s) 22 or 55 is then inserted to complete the assembly.

A still further embodiment of the clipboard of the present invention is shown in FIGS. 12–15. In this embodiment a clipboard 70 has a clamping mechanism 72 comprised of at least one paper clamp 74 on a clamping element 76, a biasing element 55 and an interlocking holding element 78. The holding element 78 is interlocked with the clamping element 76 by means of grove or ridge 80 formed at on end of the holding element.

Figure 13:
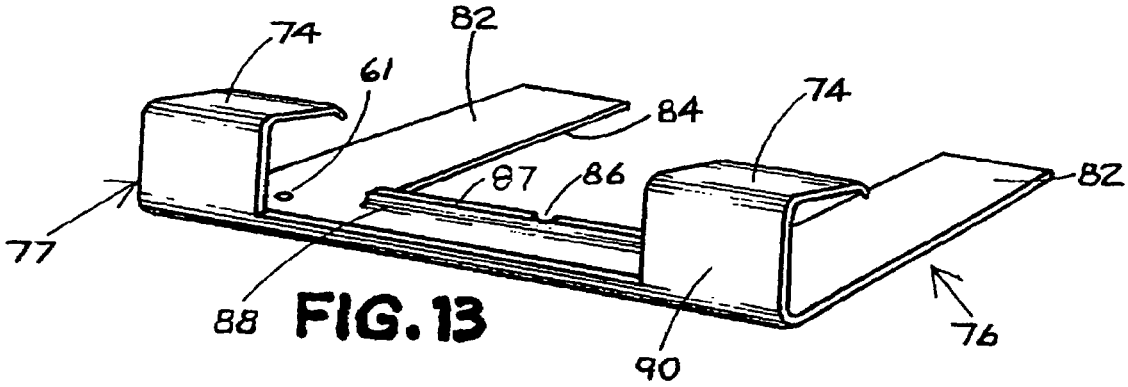
FIG. 13 is a top perspective view of a paper clamping element or portion of the clamping mechanism shown in FIG. 12.

As shown in FIG. 13, the clamping element 76 is formed from a substantially rectangular plate 77 and has one or more paper clamps 74 formed thereon at a first end 90. The rectangular plate 77 may include an aperture 84 formed between clamping arms 82 and an alignment tab 86 may be formed on a raised lip 87 at one end of the aperture, adjacent to and between the clamps 74. When the clipboard 70 is assembled the holding elements 78 are secured to the rear face 13 of the planar board member 11 in any desired manner, for example, by an adhesive or the like. The one or more holding elements 78 cooperate with the one or more clamping arms 82. Additionally, one or more biasing elements 55 are held in a spring channel 88 formed between the raised lip 87 and the clamps 74 on the clamping element 76.

It, therefore, can be seen that the clamping element 76 and the holding elements 78 are interlocked together during assembly of the clipboard 70.

If desired, a writing implement holder may be secured to the rear face 13 of the board 11 adjacent the end 90 of the clamping element 76.

Figure 14:
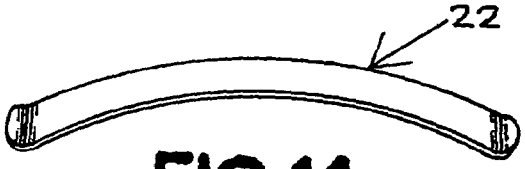
FIG. 14 is perspective view of a spring biasing element of the present invention.

FIG. 14 shows a leaf spring 22 that may be used in any of the embodiments of the invention by being inserted into the respective spring channel. The leaf spring 22 preferably includes slight curls at the ends to reduce friction between the rear face of the planar board and the respective spring channel when being depressed.

Figure 15:
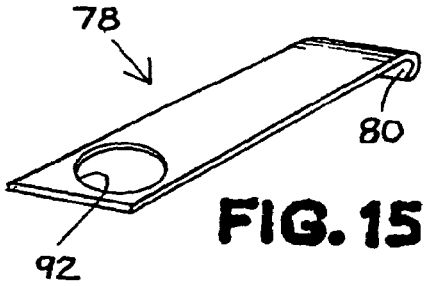
FIG. 15 is a top perspective view of a holding or pivoting element of the clamping mechanism shown in FIG. 12.

FIG. 15 illustrates a holding element 78 having an aperture or opening 92 at one end for receiving and holding a coil spring 55 under each clamp 74.

Those skilled in the art will appreciate that various adaptations and modifications of the just described preferred embodiments can be configured without departing from the scope and spirit of the invention. Therefore, it is to be understood that, within the scope of the appended claims, the invention may be practiced other than as specifically described herein.

I claim:

1. An improved clipboard comprising:

a planar board member having a front face, a rear face, a pair of side edges, a top end, a bottom end and at least one slot passing through the planar board member, adjacent the top end;

a clamping mechanism having a clamping element with at least one paper clamp, a holding element and at least one biasing element; and the clamping element being mounted adjacent the rear face of the planar board member with the at least one paper clamp penetrating through the at least on slot from the rear face to the front face.

2. The clipboard of claim 1 wherein the clamping element is a single piece substantially rectangular plate having at least one clamp extending from a top surface thereof and at least one clamping arm.

3. The clipboard of claim 2 wherein the clamping element has a pair of laterally spaced clamps and a pair of clamping arms with an aperture formed between the clamping arms.

4. The clipboard of claim 3, further including a spring channel formed in the clamping element for holding the at least one biasing element and a handle formed in the planar board member.

5. The clipboard of claim 1 wherein the clamping element has a pair of laterally spaced clamps and the planar board member has a pair of laterally spaced slots that conform to the configuration of the pair of clamps.

6. The clipboard of claim 5, further including a pair of holding elements secured to the rear face of the planar board member and cooperating with a pair of clamping arms, and wherein the clamping element has a spring channel formed therein.

7. The clipboard of claim 6 wherein the holding elements include openings to serve as seats for coiled springs and a handle is formed in the planar board member.

8. The clipboard of claim 1 wherein the planar board member has a plurality of notches on the side edges thereof, adjacent the bottom end.

9. The clipboard of claim 1 wherein the clamping element and the holding element are formed as one piece.

10. The clipboard of claim 9 wherein the clamping element has a pair of laterally spaced paper clamps and the planar board member has a pair of laterally spaced slots that conform to the configuration of the paper clamps.

11. The clipboard of claim 10, further including a writing implement holder integrally formed with the holding element; the writing implement holder extending over the top end of the planar board member.

12. The clipboard of claim 11, further including a spring channel in the clamping element for holding the at least one biasing element and a handle formed in the planar board member.

13. The clipboard of claim 1 wherein the clamping element and the holding element are formed as separate substantially rectangular elements.

14. The clipboard of claim 13 wherein the clamping element has a pair of laterally spaced paper clamps and the planar board member has a pair of laterally spaced slots that conform to the configuration of the paper clamps.

15. The clipboard of claim 14, further including a writing implement holder integrally formed with the holding element; which writing implement holder extends over the top end of the planar board member.

16. The clipboard of claim 15, further including a spring channel formed in the clamping element for holding the at least one biasing element and a handle formed in the planar board member.

17. A clipboard comprising:

a planar board member having a front face, a rear face, a pair of side edges, a top end, a bottom end and at least one slot passing through the planar board member, adjacent the top end;

a clamping mechanism having a clamping element with at least one paper clamp formed as one piece with a holding element, and at least one biasing element; and the clamping element being mounted adjacent the rear face of the planar board member with the at least one paper clamp penetrating through the at least one slot from the rear face to the front face.

18. The clipboard of claim 17 wherein the clamping mechanism is a substantially rectangular plate having a top end and a bottom end, a pair of laterally spaced paper clamps, a spring channel extending between the pair of laterally spaced paper clamps for holding the at least one biasing element, and a cylindrical channel extending along a width of the rectangular plate top end to form a writing implement holder, and a handle formed in the planar board member.

19. A clipboard comprising a planar board member having a front face, a rear face, a pair of side edges, a top end, a bottom end and at least one slot passing through the planar board member, adjacent the top end;

a clamping mechanism having a clamping element with at least one paper clamp, a separate holding element, and at least one biasing element; and the clamping element and the holding element being mounted adjacent the rear face of the planar board member with the at least one paper clamp penetrating through the at least one slot from the rear face to the front face.

20. The clipboard of claim 19 wherein the clamping element is a substantially rectangular plate with a top end and a bottom end, a pair of laterally spaced paper clamps and a spring channel extending between the pair of laterally spaced paper clamps for holding the at least one biasing element; and the holding element is a substantially rectangular plate with a cylindrical channel extending along a width of a top end of the rectangular plate to form a writing implement holder; and a handle is formed in the planar board member.

* * * * *